United States Patent [19]

Hufnagl et al.

[11] Patent Number: 4,720,280

[45] Date of Patent: Jan. 19, 1988

[54] WAVE SKI

[76] Inventors: Ernest Hufnagl, 1/640 Bunnerong Road, Matraville; Christopher J. Fields, 39 Brisbane Street, Chifley, both of Sydney, Australia, 2036

[21] Appl. No.: 873,166

[22] Filed: Jun. 4, 1986

[30] Foreign Application Priority Data

Jul. 31, 1985 [AU] Australia ..... PF1737

[51] Int. Cl.[4] ..... A63C 15/05

[52] U.S. Cl. ..... 441/74; 441/79; 441/130

[58] Field of Search ..... 441/65, 67, 68, 72, 441/73, 74, 79; 114/363, 364, 347, 127, 140, 39.2

[56] References Cited

U.S. PATENT DOCUMENTS 1,058,855 4/1913 Gerardin ..... 114/363

4,229,850 10/1980 Arcouette ..... 114/347

FOREIGN PATENT DOCUMENTS 3238273 5/1983 Fed. Rep. of Germany ..... 441/74

*Primary Examiner*—Joseph F. Peters, Jr.

*Assistant Examiner*—Jesûs D. Sotelo

*Attorney, Agent, or Firm*—Vorys, Sater, Seymour & Pease

[57] ABSTRACT

An improvement to a wave ski comprising an adjustable seat which slides longitudinally along a track located on the upper surface of the wave ski and a fin associated with the seat, whereby the user can simultaneously adjust the longitudinal position of the seat by the use of footrests and the fin on the wave ski. In another embodiment of the invention, the adjustable seat which moves longitudinally along a track located on the upper surface of the wave ski and the fin associated with the seat includes a slot extending longitudinally along or adjacent to the center line of the wave ski and is adapted to receive the fin or portion of the seat, whereby the user can again simultaneously adjust the longitudinal position of the seat and fin on the wave ski.

19 Claims, 4 Drawing Figures

WAVE SKI

BACKGROUND OF THE INVENTION

The present invention relates to improved wave ski and in particular it relates to a moveable fin affixed thereto.

Although there exists and have existed a great number of wave skis, certain limitations are associated with those wave skis. In particular the known wave skis are manufactured with a fixed positioned centre fin and with a concave section in which the wave skier sits. Both of these features limit the skier in his manoeuvrability and performance in waves.

Two of the roles of a fin on a wave ski are firstly lateral stability and secondly directional stability. When the wave skier redirects his wave ski in the water, the fin provides the propelling stability and balancing control necessary in the water. By having the fin in a fixed position on the wave ski, the skier is limited to the type and variation of the manoeuvres possible and the speed at which he travels in the water. The present invention enhances the stabilising function of the fin by allowing the fin to be moved forward while the skier is in motion in the water to correct any lateral and directional instability created by the variation of the force and by directional changes of the wave caused when there is a change of direction of the wave ski. This new stabilising ability allows the skier to maintain and improve the speed at which he travels through the water.

A further problem with known existing wave skis is the concave section, moulded into the ski at approximately the central position of the wave ski, in which the skier sits. The fixed seating section restricts the skier to one position on th ski from which to direct and balance the wave ski through the water. Therefore the skier's manoeuvrability and speed are subject to his ability to maintain stability from that one position. The present invention allows the skier to change the centre of gravity of the wave ski by moving the seat forward or backward to correct any imbalance created by the variation in force and by the directional changes of the waves. The fin by being attached to the base of the moveable seat shifts along the length of the wave ski as the skier adjusts his position and provides simultaneous lateral stability to the skiers balance correction.

A further problem with the known wave skis with the said fixed seating sections, that the skier's propelling ability through the waves is determined primarily by the force and break of the waves. The present invention by allowing the skier to move forward on the wave ski by use of the moveable seat changes the centre of gravity and the aquadynamics of the wave ski by shifting the weight ratios to the forward section of the wave ski and thereby allowing greater wave force under the wave ski causing additional speed through the water.

The present invention seeks to ameliorate the abovementioned disadvantages.

SUMMARY OF THE INVENTION

In one broad form the present invention comprises a wave ski comprising:

a seat adapted to move longitudinally along the wave ski; and a fin associated with the seat;

whereby the user can adjust simultaneously the longitudinal position of the seat and the fin on the wave ski.

In another form the wave ski comprises a wave ski comprising:

a seat adapted to move longitudinally along the wave ski;

a fin associated with the seat; and a slot extending longitudinally along or adjacent to the centre line of the wave ski and adapted to receive the fin or portion of the seat therein;

whereby the user can adjust simultaneously the longitudinal position of the seat and fin on the wave ski.

BRIEF DESCRIPTION OF THE DRAWINGS

The invention will now be described by way of example with reference to the accompanying drawings in which.

DETAILED DESCRIPTION OF THE PREFERRED EMBODIMENTS

Figure 1:
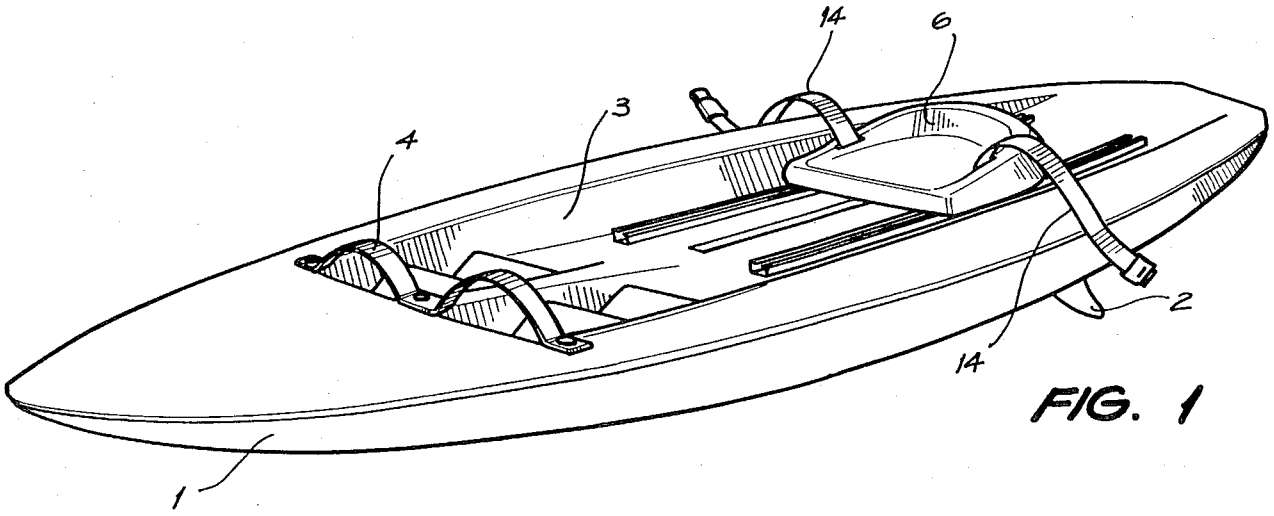
FIG. 1 illustrates one embodiment of the wave ski of the present invention with the moveable seat in a rearward position on the wave ski.
Figure 2:
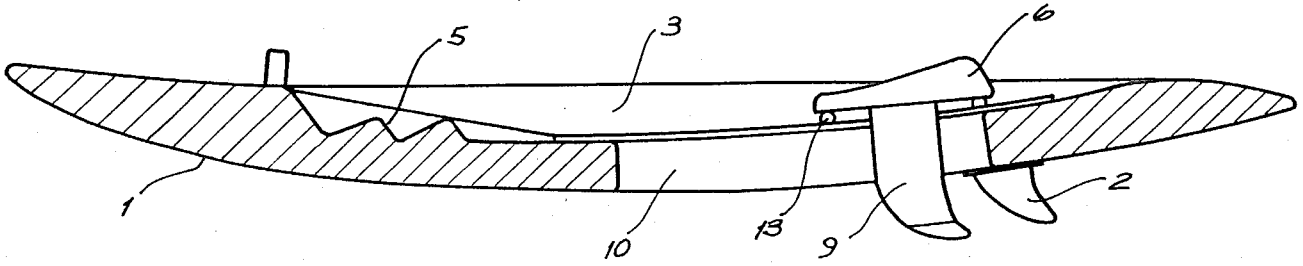
FIG. 2 illustrates a cut away section of the wave ski illustrated in FIG. 1.

The preferred embodiment of the invention is illustrated in the beforementioned FIGS.

The wave ski comprises a conventional floatation hull 1 having fixed fins 2 located adjacent the rear of the hull 1 and extending from the bottom of the surface thereof.

Located on the upper surface of the hull 1 is a recess 3 which contains adjacent its forward end strap members 4 through which the user's feet can extend. Located behind the strap are several steps 5 which the user can utilise as foot rests so as to place his feet in different positions depending on the position of the seat 6 along the wave ski.

Figure 3:
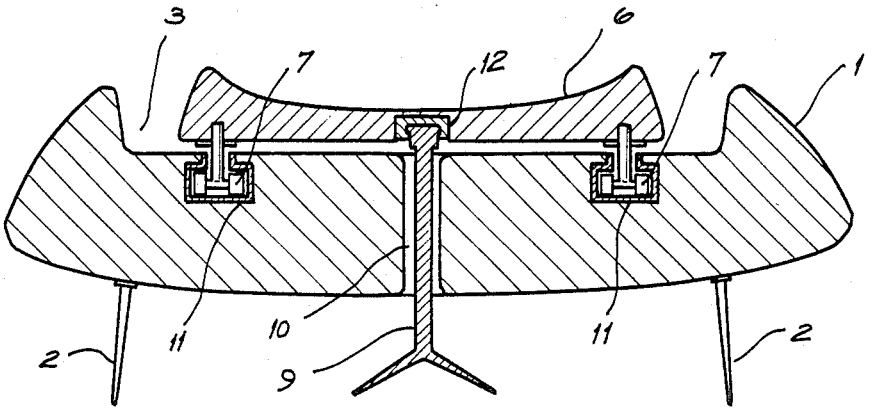
FIG. 3 illustrates a sectional view of another embodiment of the wave ski illustrated in FIG. 1.
Figure 4:
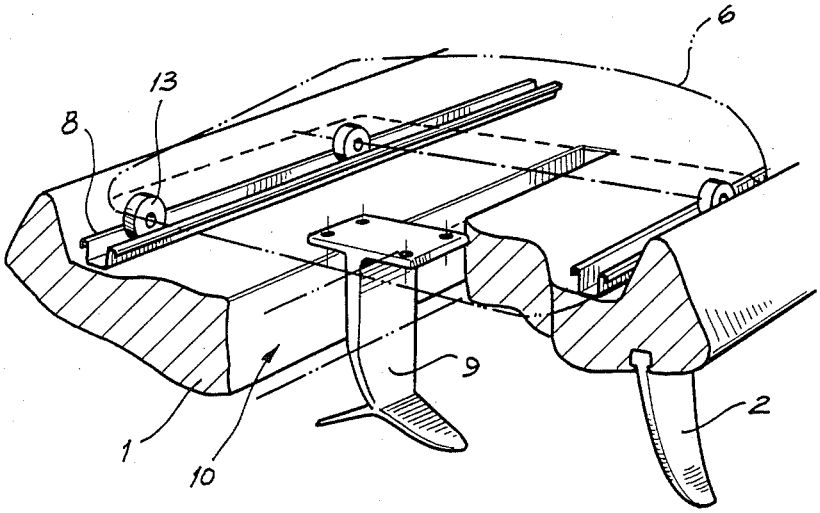
FIG. 4 illustrates a cut away view viewed from above the wave ski of the embodiment illustrated in FIG. 1 with the seat illustrated in phanton lines for clarity.

The seat 6 comprises on its underside wheel 13 or roller means 7 (as shown in FIG. 3 and 4). As shown in FIG. 3 the roller means 7 travel in a T shaped channel 11 which holds the sea against falling out of contact with the track. Located in the base of the seat 6 is a fin box 12 into which the fin 9 can be inserted and locked into position.

As shown in FIG. 4 a further embodiment is illustrated in which the roller means 13 travel in a U shaped channel 8 which extends longitudinally along the recess 3. Extending from the under surface of the seat substantially in the centre thereof is a fin 9. The fin 9 is affixed to the seat 6 by means of four screws or the like. The fin 9 extends through the longitudinal extending slot 10 in the recess 3 of the hull 1 such that the fin 9 moves along the hull 1 with the seat 6.

The seat 6 is fixed with a strap 14 on either side of the seat and the straps are fitted with an interlocking device to secure the wave skier in the seat while manoeuvering the wave ski through the water.

One embodiment of the hull is adapted to receive a known wind surfing mast and sail thereby converting the present invention from a wave ski to a wind surfer.

The invention will allow wave skiers much greater stability and manoeuvrability while wave skiing and will improve a skier's performance and speed control beyond that which known wave skis could provide. It is an advantage of the invention that the skiers are not limited to one sitting position and it is a feature of this invention that the length of the slot 10 size and shape of the moveable seat 6 can be made to suit the requirements of individual wave skiers.

The claims defining the invention are as follows:

1. A wave ski comprising:

a floatation hull having a lower hull surface, a track means connected to and extending longitudinally relative to said floatation hull, a user seat moveable by the wave ski user on said track means longitudinally along said floatation hull, a movable fin having a fin tip extending generally below said lower hull surface, said movable fin being secured to said user seat and movable therewith relative to said floatation hull so that the user can simultaneously reposition said user seat and said movable fin relative to said floatation hull, and a fixed fin fixed to said floatation hull at the aft portion thereof and extending generally down from said lower hull surface.

2. the wave ski of claim 1 including, a fixing means for fixing said movable fin to the under surface of said user seat substantially in the center thereof, and said floatation hull including a longitudinal slot through said lower hull surface and through which said movable fin extends and in which it travels.

3. The wave ski of claim 2 including, said fixing means including a fin box positioned in the base of said user seat and into which said movable fin can be inserted.

4. The wave ski of claim 2 including, said fixing means including a plurality of screws.

5. The wave ski of claim 1 including, said track means including a U-shaped channel.

6. The wave ski of claim 1 including, said track means including a T-shaped channel.

7. The wave ski of claim 1 including, a plurality of steps spaced longitudinally along said floatation hull defining a plurality of user foot rests to accommodate the different positions of the feet of the user seated on said user seat dependent on the position of said user seat relative to said floatation hull.

8. The wave ski of claim 1 including, said floatation hull including a receiving means for receiving a wind surfing mast and sail.

9. A wave ski comprising:

a hull, a seat adapted to move longitudinally along said hull, said hull defining a slot extending longitudinally therealong, and a fin operatively associated with said seat through said slot such that a user of the wave ski can simultaneously adjust the longitudinal positions of said fin and said seat relative to said hull.

10. The wave ski of claim 9 including, said slot extending longitudinally along the center line of said hull.

11. The wave ski of claim 9 including, said slot receiving a portion of said seat therein.

12. The wave ski of claim 11 including, said slot extending longitudinally along the center line of said hull.

13. The wave ski of claim 9 including, said slot receiving said fin therein.

14. The wave ski of claim 13 including, a fixing means for fixing said fin to the under surface of said seat.

15. The wave ski of claim I4 including, said fixing means comprising a fin box positioned in the base of said seat and into which said fin can be inserted.

16. The wave ski of claim 9 including, a fixed fin fixed to said hull at an aft portion thereof and extending generally down from the lower surface of said hull.

17. The wave ski of claim 9 including, said hull having a pair of opposed sides and a lower hull surface disposed between said opposite sides, and said slot passing through said lower hull surface.

18. The wave ski of claim 9 including, said fin being disposed directly beneath said seat and fixed in position along its entire fin length relative to said seat.

19. The wave ski of claim 9 including, a means at the base of said seat into which said fin can be inserted and locked into place.

* * * * *